US006611414B1

(12) United States Patent
Lavelle et al.

(10) Patent No.: US 6,611,414 B1
(45) Date of Patent: Aug. 26, 2003

(54) CONTROL SYSTEM FOR ELECTROMAGNETIC LOCK

(75) Inventors: Gary E. Lavelle, Avon, CT (US); James P. Krul, East Hartford, CT (US)

(73) Assignee: Harrow Products, Inc., Grand Rapids, MI (US)

( * ) Notice: Subject to any disclaimer, the term of this patent is extended or adjusted under 35 U.S.C. 154(b) by 813 days.

(21) Appl. No.: 08/707,206

(22) Filed: Aug. 30, 1996

(51) Int. Cl.[7] ..... H01H 47/00
(52) U.S. Cl. ..... 361/154
(58) Field of Search ..... 361/144, 154

(56) References Cited

U.S. PATENT DOCUMENTS

RE31,391 E * 9/1983 Davis et al. ..... 361/154
4,608,620 A * 8/1986 Hines ..... 361/154
4,797,779 A * 1/1989 Richards et al. ..... 361/154
4,840,411 A 6/1989 Sowersby ..... 292/251.5
4,861,080 A 8/1989 Frolov ..... 292/251.5
4,878,147 A * 10/1989 Oyama et al. ..... 361/154
4,981,312 A 1/1991 Frolov ..... 292/251.5
5,016,929 A 5/1991 Frolov ..... 292/251.5
5,089,925 A * 2/1992 Lester ..... 361/84
5,184,855 A 2/1993 Waltz et al. ..... 292/251.5

* cited by examiner

*Primary Examiner*—Fritz Fleming
(74) *Attorney, Agent, or Firm*—Alix, Yale & Ristas, LLP

(57) ABSTRACT

An electromagnetic door lock has an electromagnet and an armature for bonding thereto. One of the electromagnet and the armature is adapted for mounting to a door and the other of the electromagnet and the armature is adapted for mounting to a door frame. A lock controller pulses current to the electromagnet. The pulses have a predetermined width and a predetermined spacing between pulses.

24 Claims, 6 Drawing Sheets

CONTROL SYSTEM FOR ELECTROMAGNETIC LOCK

FIELD OF THE INVENTION

This invention relates to electromagnetic door locks, and more particularly, to methods and devices for controlling the electromagnet of the electromagnetic door lock.

BACKGROUND OF THE INVENTION

Electromagnetic door locks for the securement of a door to a door frame are well known. Conventional electromagnetic door locks employ an electromagnet which selectively electromagnetically bonds with an armature. One of the electromagnet and the armature is mounted to the door and the other of the electromagnet and armature is mounted to the door frame. A lock controller controls the energization of the electromagnet, and therefore the bonding engagement of the armature to the electromagnet.

In one form of an electromagnetic lock, commonly referred to as a shear lock, the electromagnet is mounted within a mortise in the door frame and oriented toward the edge of the door. The armature is positioned within a mortise in the door edge, whereby when the door is closed, the electromagnet and armature are in opposing relationship. These types of shear locks are particularly suitable for mounting on many types of swinging or double-acting doors. Also, shear locks are preferred for aesthetic reasons over door face mounted electromagnetic locks due to the concealment of the, electromagnet and armature.

Prior shear locks have attempted to compensate for the potentially inadequate securing force by providing for a mechanical engagement of the electromagnet and armature. The mechanical engagement is formed when the armature is electromagnetically bonded to the electromagnet. Conventional mechanical engagement configurations have included interlocking projections and recesses, such as disclosed in Frolov U.S. Pat. Re. No. 35,146. The mechanical engagement of the electromagnetically bonded armature and electromagnet provides a reliable and high level of shear resistance while still providing the advantages of the electromagnetic shear lock.

The armature and electromagnet are typically installed to form a gap between the components. The gap is required to allow for clearance so that the armature can swing past the face of the electromagnet as the door swings open and closed. Additionally, the gap can increase due to door sag and component misalignment. The armature is conventionally constructed to move toward the electromagnet to close this gap when the armature and electromagnet engage. The armature movement is also employed to facilitate the mechanical engagement of the projections and recesses. However, the electromagnet must generate a substantial electromagnet force to overcome the gap between the armature and the electromagnet and thereby engage the components.

The electromagnetic force of an electromagnet is proportional to the coil current. However, when the coil current is high, the electromagnet can generate significant heat. This may be especially critical when the electromagnet is mortised into a wood door frame. The wood door frame can thermally insulate the electromagnet therefore limiting the ability of the electromagnet to dissipate heat. Excessive coil heat can lead to failure of the electromagnet and a shortened lifetime.

A further limitation of many conventional electromagnetic locks, both shear locks and other arrangements, is that the locks are typically designed to operate at only a single voltage. Therefore, in many cases, manufacturers must produce, and distribute multiple models of electromagnetic locks which primarily differ only in the required input voltage. As a partial solution, some forms of field voltage selectibility for a given lock have been developed. The selection of the operating voltage can typically be implemented by the use of multiple wire leads, jumpers or by actuation of a switch. However, for each of the latter selection configurations, the electromagnetic lock is only capable of functioning at the preset voltage, whether that voltage is selected by the manufacturer or in the field at the time of installation.

SUMMARY OF THE INVENTION

Briefly stated, a lock controller in accordance with the invention selectively varies the current supplied to the coil of the electromagnet. The lock controller is preferably employed with an electromagnetic shear lock. However, the lock controller in accordance with the invention is also suitable for employment with electromagnetic locks mounted to the face of the door, and other arrangements of electromagnetic lock applications and designs.

During operation, a typical electromagnetic shear lock requires a high initial current to the electromagnet to produce a high level of electromagnetic attraction between the electromagnet and the armature. When the armature and the electromagnet are widely separated, this relatively large amount of magnetic force is required to attract the armature across the gap. Once the armature is in surface to surface contact with the electromagnet, only a smaller amount of electromagnetic force is required to be generated by the electromagnet. This electromagnetic force need only be sufficient to maintain the armature in place. The principal locking action between the electromagnet and the armature is accomplished by positive mechanical engagement of the electromagnet and the armature.

The lock controller in accordance with the invention preferably provides a high initial current to the electromagnet to close the gap between the electromagnet and the armature. The high electromagnetic force results from the high initial current supplied through the coil of the electromagnet.

After a preestablished time interval the lock controller reduces the current through the coil to an intermediate level. After the components are engaged, the reduced current is sufficient to maintain the electromagnet and armature in an electromagnetic bonding arrangement whereby the mechanical engagement is provided between the electromagnet and the armature. However, the reduced current through the coil lower power dissipation which results in favorable heating characteristics of the electromagnet that are not detrimental to the longevity or effectiveness of the lock system.

In the preferred form of the lock controller, the lock controller has a microcontroller and a switch assembly. The switch assembly selectively connects the electrical current to the coil of the electromagnet. The microcontroller actuates the switch assembly to turn on and off the current supplied to the coil to generate a pulse train having a modulated pulse width. The microcontroller, by use of the switch assembly, preferably generates periodic pulses of electrical current at a constant frequency. The average current is therefore controlled by varying the width of the pulse, or the amount of time the switch assembly is turned on. At the initial current level, the coil will have current directed through it for periodic predetermined amounts of time, or what is described as having a pulse of a certain width. At the reduced or intermediate current, the width of the pulse, or the period of time the switch assembly is on, is reduced. Therefore, the average current through the coil at the intermediate pulse width, is less than the average current through the coil at the initial pulse width.

In an alternate embodiment of the invention, the lock controller monitors the input power voltage supplied to the electromagnetic lock. The microcontroller controls or modulates the pulse width of current to the coil of the electromagnet in relation to the input voltage. Therefore, the lock controller automatically adjusts the coil current to compensate for the voltage supplied to the electromagnetic lock. Furthermore, even if the input voltage varies over time, the lock controller will continue to monitor and modulate the current to the coil to generate a suitable electromagnetic bonding strength regardless of the input voltage supplied to the electromagnetic lock. In one lock controller constructed in accordance with the invention, the lock controller can control the electromagnet for an input voltage range of from 10 to 35 volts.

An object of the invention is to provide a control system that controls the current supplied to the coil of an electromagnet.

Another object of the invention is to provide a control system for an electromagnet lock that controls the current supplied to the magnet coil in accordance with the operational status of the lock.

A further object of the invention is to provide a lock controller that can automatically adjust for changes in the input voltage supplied to the electromagnetic lock.

A still further object of the invention is to provide an electromagnetic lock that is efficient and reliable and exhibits favorable heat characteristics.

These and other objects of the invention will become apparent from the specification and the drawings.

DETAILED DESCRIPTION OF THE PREFERRED EMBODIMENT

Figure 1:
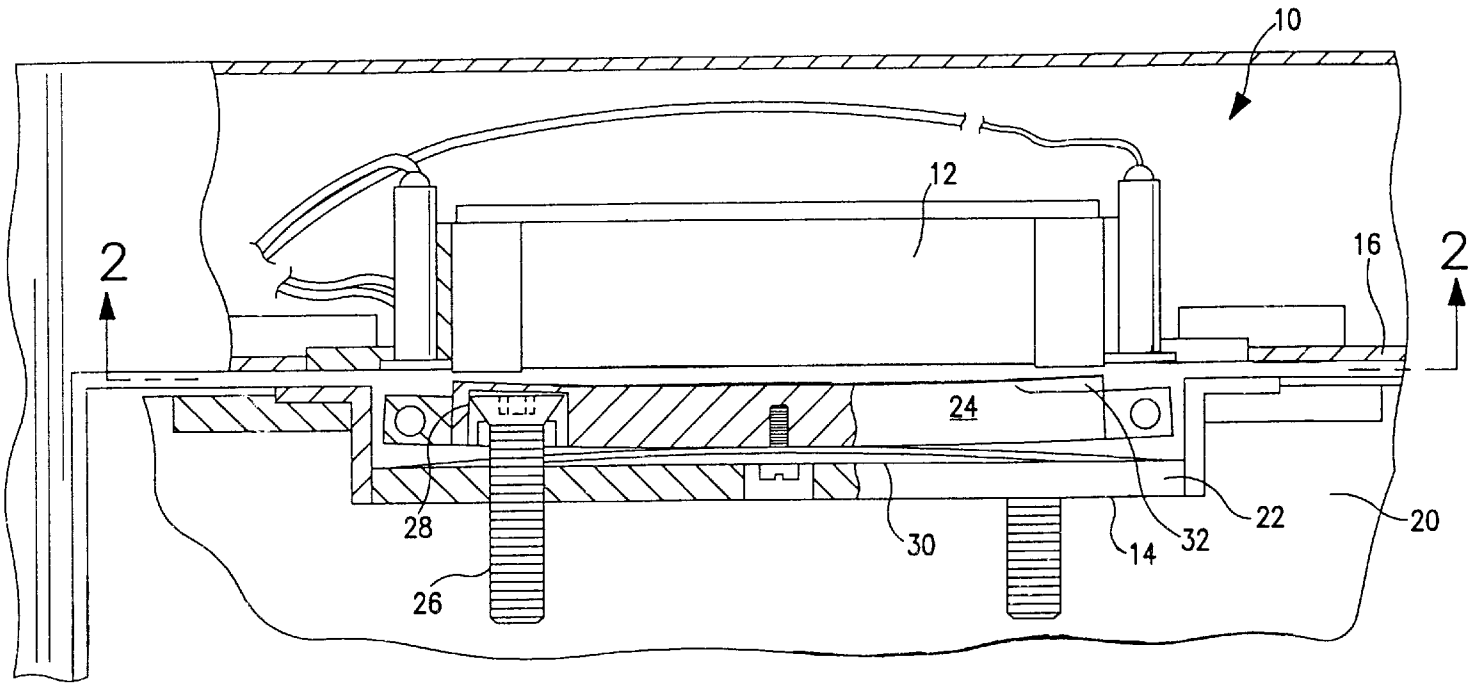
FIG. 1 is a front elevation of a portion of a door frame partially cut away, to show the installation of an electromagnetic shear lock comprising an electromagnet and an armature.
Figure 2:
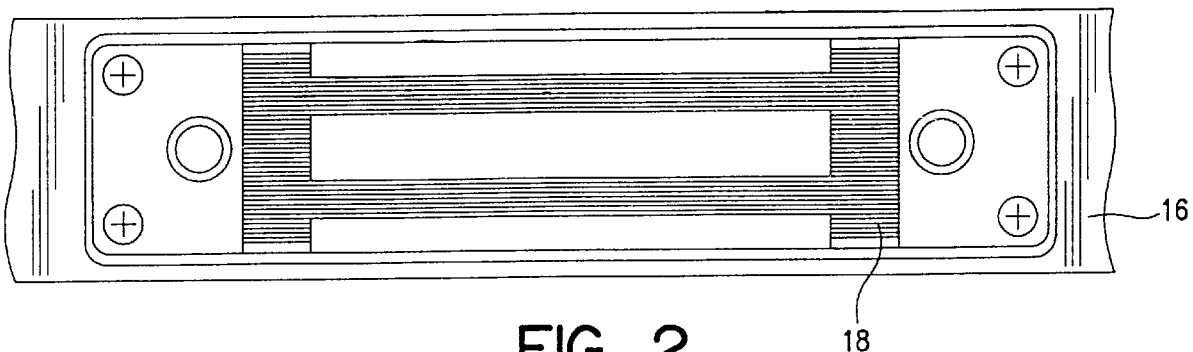
FIG. 2 is an end on view of the electromagnet of FIG. 1 seen in the plane 2—2 of FIG. 1.
Figure 3:
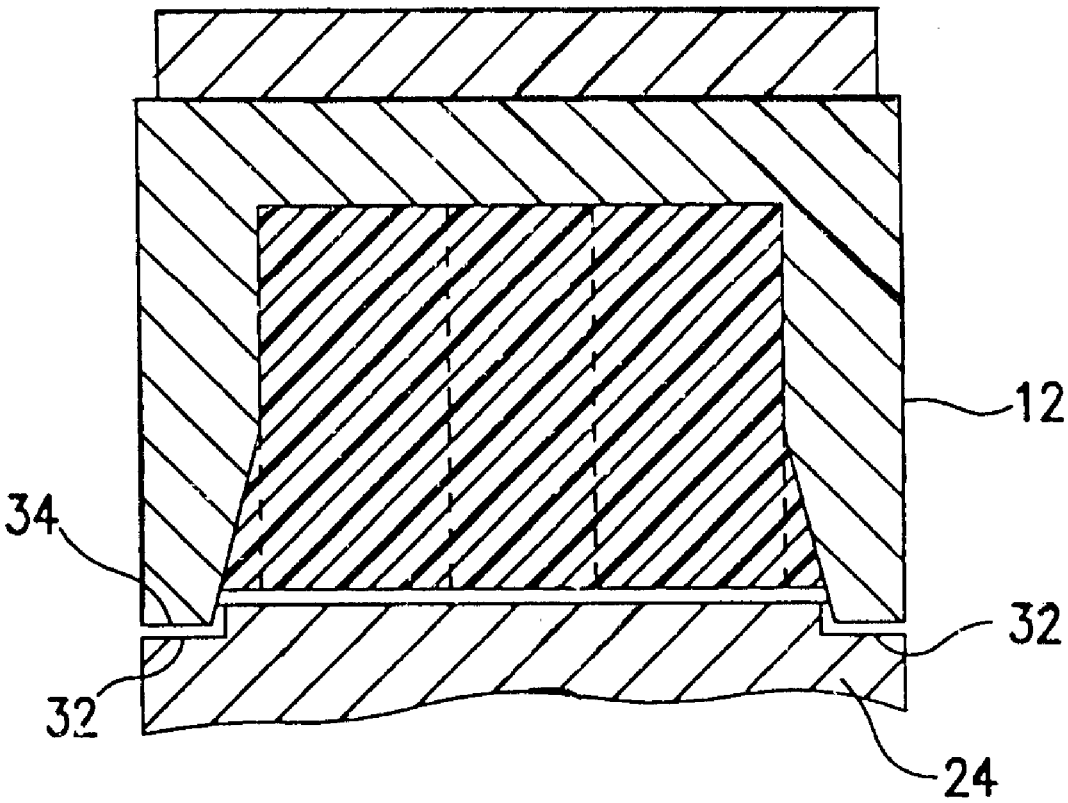
FIG. 3 is a cross sectional view of the electromagnet and armature of FIG. 1 taken along the line 3—3.
Figure 4:
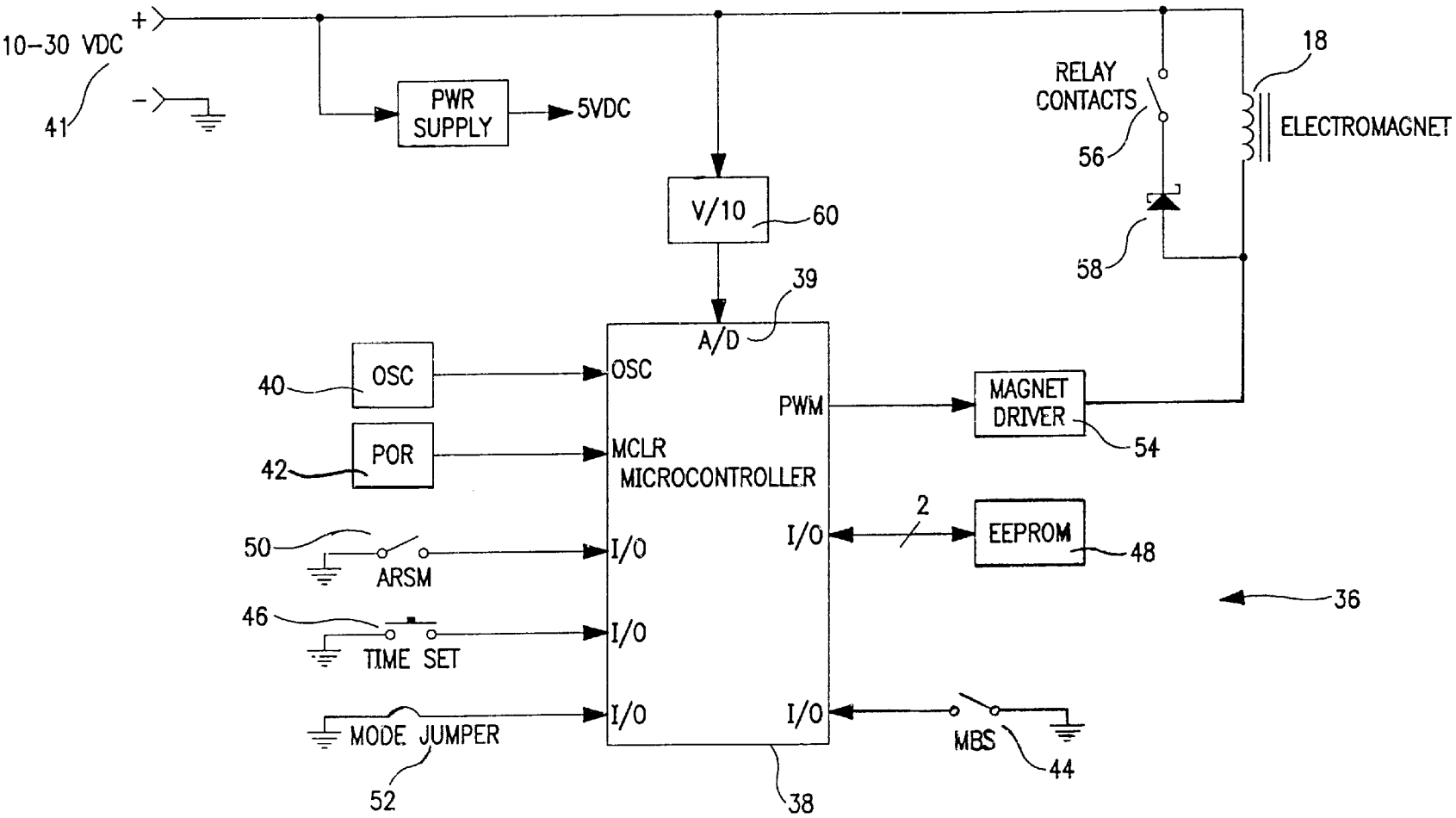
FIG. 4 is a simplified electrical schematic of a lock controller in accordance with the invention for use with an electromagnetic shear lock shown in FIG. 1.

With reference to the drawings wherein like figures represent like components, an electromagnetic lock for employment with the lock controller in accordance with the invention is generally designated by the numeral 10. The electromagnetic lock 10 has an electromagnet assembly 12 and an armature assembly 14. The electromagnet assembly 12 is typically mounted in a mortise defined by a door frame 16. The electromagnet 12 is constructed from a series of E-shaped laminations. A coil 18 surrounds the center leg formed by the E-shaped laminations.

The armature assembly 14 is mounted in a mortise in a door 20 mounted to the door frame 16. The armature assembly 14 is positioned in the door whereby when the door 20 is closed, the electromagnet assembly 12 and armature assembly 14 align in opposing relationship. The armature assembly 14 has an armature support plate 22 mounted at the bottom of the door mortise. A pair of armature supports 26 threadably engage the armature support plate 22 and extend into recesses 28 in an armature plate 24. An armature spring 30 is fixed to the back of the armature plate 24 and engages the armature supports 26. The armature spring 30 biases the armature plate 24 away from the electromagnet assembly 12. When the electromagnet 12 is de-energized, a gap is defined between the armature plate 24 and the electromagnet assembly 12. Energization of the coil 18 of the electromagnet assembly 12 attracts the armature plate 24 to the electromagnet, overcoming the spring bias force of the armature spring 30, and bringing the armature plate 24 and the electromagnet assembly 12 into contact. The invention is also applicable to electromagnetic assembly configurations wherein the electromagnet is suspended on springs and moves into the gap upon energization.

The electromagnet assembly 12 and armature plate 24 preferably also mechanically engage when they are electromagnetically engaged. The mechanical engagement provides additional resistance to shear forces that arise due to an attempted forced door opening. In one preferred form, the armature plate 24 defines a plurality of locking recesses 32. The electromagnet assembly 12 further has a plurality of locking extensions 34 extending from the attractive face of the electromagnet assembly 12. The locking extensions 34 extend into the armature recesses 32 when the armature plate 24 and electromagnet assembly 12 are electromagnetically engaged. The mechanical engagement of the locking extensions 34 in the locking recesses 32 provides additional resistance to shear forces placed on the electromagnetic lock 10.

A lock controller 36 in accordance with the invention controls the energization of the coil 18 of the electromagnet assembly 12. The lock controller has a microcontroller 38 which provides all logic and control functions to the lock controller 36. One preferred model of microcontroller is a PIC16C71 marketed by Microchip Technology Inc. of Chandler, Ariz. An oscillator 40 which serves as a clock for all operations of the microcontroller 38. A power on reset circuit 42 starts the lock controller 36 when power is applied, and inhibits operation of the lock controller 36 when the voltage supplied to the microcontroller 38 drops below a threshold level.

The microcontroller 38 monitors an automatic relock switch (ARSM) 50 to determine the status of the door 20. The automatic relock switch 50 generates an door status signal indicative of the status of the opened or closed door 20. The automatic relock switch 50 is preferably a reed switch mounted to the door frame 16 and triggered by a permanent magnet mounted to the door 20. The microcontroller 38 further monitors a magnetic bond sensor (MBS) 44 to determine the quality of magnetic bond between the armature plate 24 and the electromagnet assembly 12. The magnetic bond sensor 44 generates a signal indicative of the integrity of the electromagnetic holding force between the electromagnet assembly 12 and the armature plate 24. The MBS 44 therefore indicates adequate locking of the electromagnetic lock 10. The magnetic bond sensor 44 is responsive to low line voltage and/or foreign material in the magnetic gap between the electromagnet assembly 12 and the armature plate 24, and/or dirty or damaged surfaces on the electromagnet assembly 12 or the armature plate 24.

A push button relock time delay switch 46 is used to set the relock time of the electromagnetic lock 10 after de-energization of the electromagnet. During installation of the lock controller 36, the amount of relock time delay is field selected by touching the relock time delay switch 46 a certain number of times. Each touch of the relock time delay switch 46 is preferably equivalent to one second of relock time delay of the electromagnetic lock 10.

The relock time delay setting is stored in an electrically erasable, programmable read only memory (EEPROM) 48 in serial communication with the microcontroller 38. The microcontroller 38 can also read additional data from the EEPROM 48, and erase the data and write new data to the EEPROM 48. The data stored within the EEPROM 48 is retained without a continual application of electrical power, therefore the EEPROM maintains the stored data during power down and unlocked cycles.

The microcontroller 38 controls the current supplied to the coil 18 of the electromagnet assembly 12 by actuation of a magnet driver or solid state switch assembly 54. The switch assembly 54 has a metal oxide semiconductor field effect transistor (MOSFET) which switches to pulse the current supplied to the coil 18 of the electromagnet assembly 12 on and off. A transistor amplifier controls the gate of the of the MOSFET. The switching action preferably occurs at a very high frequency. In one embodiment, the switching frequency is approximately 15 kHz. However, in some installations, this frequency can generate undesirable acoustic characteristics such as humming. Therefore, the switching frequency is preferably increased above the range of human hearing of approximately 20 kHz to, for example, 40 kHz or higher. The switching frequency generally has insubstantial effects on the temperature generation or bonding strength of the electromagnet assembly 12. The average current applied to the coil 18 is a function of the amount of time that the current is turned on by the switch assembly 54.

The microcontroller 38 modulates the width of the pulse, or the on period of the current, supplied to the coil. In one constructed embodiment, the microcontroller 38 divides a duty cycle or a time period into sixteen segments. A pulse width is therefore a preselected number of sixteenths of the entire duty cycle. For example, 44% power to the coil is achieved by a pulse width of 7/16 of the duty cycle having the current switched on to the coil 18, and 8/16 of the duty cycle having the current switched off to the coil 18. An increased pulse width, or switch assembly 54 on time, increases the total average current to the coil over a given time period, therefore generating a higher holding force between the electromagnet assembly 12 and the armature plate 24. In operation, the microcontroller 38 preferably initially provides pulses of a predetermined width wherein the average current generates a sufficient force to attract the armature plate 24 across the gap between the electromagnet assembly 12 and the armature plate 24. The initial pulse width is preferably determined to result in an average coil current equal to the maximum current for which the electromagnet assembly 12 is designed. Therefore, the greatest electromagnetic attractive force is generated to attract the armature plate 24 over the gap between the electromagnet assembly 12 and armature plate 24.

The microcontroller 38 next reduces the width of the pulses, and therefore the average current in the coil, when a predetermined time sufficient for the electromagnetic assembly 12 and the armature plate 34 to electromagnetically engage has elapsed. The electromagnet assembly 12 and armature plate 24 will typically engage in one second, therefore the pulse width is reduced after approximately one to two seconds. Since the average current to the coil is reduced, the potential for excessive heating of the coil and the electromagnet assembly 12 is reduced. In one embodiment, the reduced pulse width is generally one half of the initial pulse width. This ratio of pulse widths provides adequate bonding of the electromagnet assembly 12 and armature plate 24 while not significantly heating the coil 18. It should be recognized that the microcontroller 38 can alternately reduce the average current to the coil 18 by providing additional spacing between the pulses. Therefore, in an alternate embodiment of the invention, the pulse width is constant but the pulse spacing or switching frequency varies.

A relay 56 switches a Schottky diode 58 across the coil 18 of the electromagnet. When the electromagnet is being pulsed on by the microcontroller 38 controlling the switch assembly 54, the Schottky diode 58 allows the current to continue to flow in the coil 18 during the off portion of the duty cycle. This continued flow of current in the coil 18 maintains the desired coil current. The relay 56 opens to disconnect the Schottky diode 58 from the coil and releases the electromagnetic lock 10 without significant release delay when the input power is removed.

The microcontroller 38 further preferably adjusts the desired level of the coil current as a function of, the applied input voltage from a remote power source 41. The microcontroller 38 contains an associated integrated analog to digital (A/D) converter 39. The A/D converter 39 monitors an input voltage from 0 to 5 volts DC. The input voltage from the remote power source, is applied to the A/D converter 39 through a voltage divider 60. The voltage divider 60 divides the voltage proportionally to the input voltage, but within the input range of the A/D converter 39. Therefore, the A/D converter allows the micro controller 38 to determine through the voltage divider 60, the approximate value of the applied input voltage.

Figure 7:
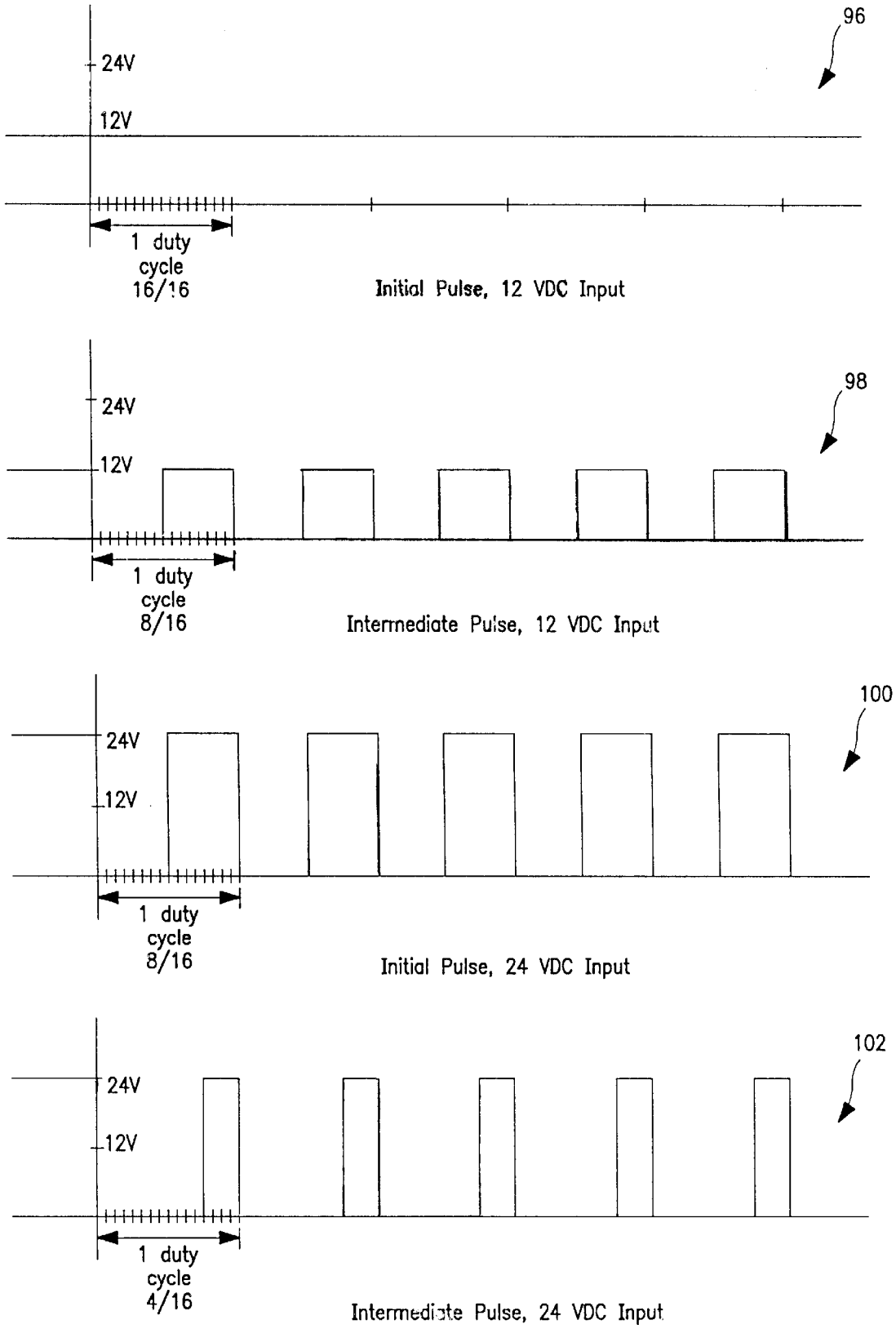
FIG. 7 is a graphical representation of input voltages and output pulses for the lock controller of FIG. 4.

With reference to FIG. 7, in one embodiment the lock controller 36 can control an input voltage range of 10–30 VDC directed to the electromagnet assembly. At an input voltage of 12 volts the coil 18 is operated at 100% power at the initial current level. Therefore the current to the coil is continually on, or the pulse width is 16/16 of the duty cycle. (See Graph 96) The pulse width is preferably reduced by approximately one half after the electromagnet assembly 12 and armature plate 34 engage. Therefore, the pulse width is reduced to 8/16 of the duty cycle, and the power to the coil is 50%. (See Graph 98) In the same embodiment, if the input voltage is approximately 24 VDC, the initial pulse width is 8/16 for 50% power to the coil. (See Graph 100) The pulse is reduced to 4/16 of the duty cycle, or 25% power to the coil, after the electromagnet assembly 12 and armature plate 34 engage. (See Graph 102) It should be recognized that 100% power at 12 VDC to the coil 18 results in equivalent bonding to 50% power at 24 VDC to the coil 18. Therefore, the bonding for the initial pulses is equivalent even though the input voltage differs. Similarly, equivalent bonding is achieved by the intermediate pulses of 50% power at 12 VDC and 25% power at 24 VDC. Furthermore, finer gradations of the current control can be accomplished by dividing the duty cycle into greater than sixteen segments.

The microcontroller 38 therefore controls the pulse width to the coil 18, at both the initial or high level, and the reduced or intermediate level, in proportion to the applied voltage from the remote power source 41. As a result, the holding force of the electromagnet will remain generally constant in a given mode, even if the input voltage from the remote power supply 41 fluctuates.

A mode select jumper 52 selectively sets the lock controller 36 in one of two operational modes. The lock controller is preferably shipped with the mode select jumper 52 intact for low temperature mode operation. The microcontroller 38 reduces the pulse width from the initial pulse width in the low temperature mode. The mode select jumper 52 may be simply cut to provide for a high holding force in all circumstances. In the high holding force mode, the microcontroller maintains the initial pulse width continually. However, the microcontroller 38 continues to modulate or adjust the pulse width in response to the input voltage.

Figure 5:
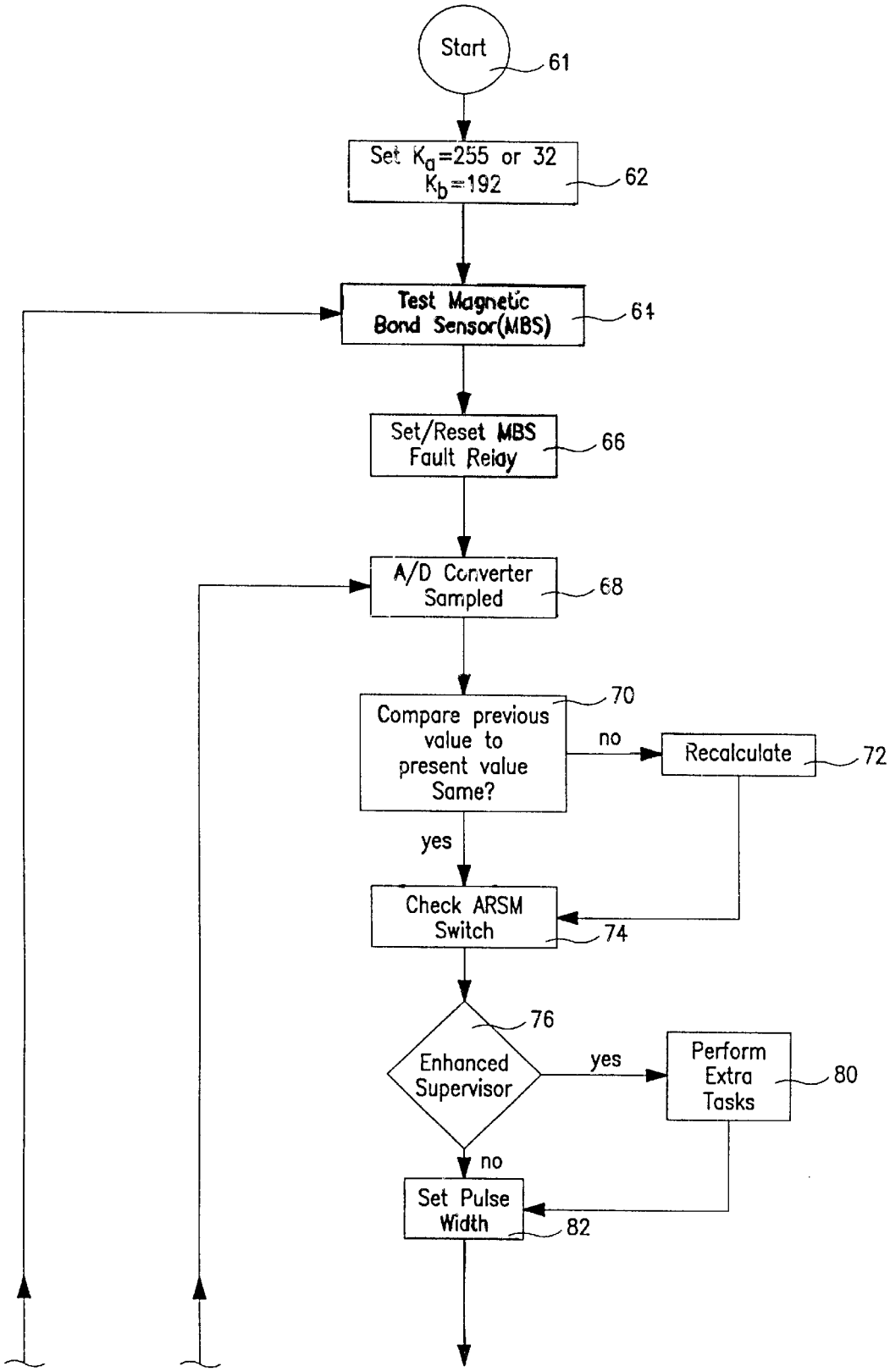
FIG. 5 is a first portion of a flow chart of the main monitoring and pulse width generation program of the lock controller of FIG. 4.
Figure 6:
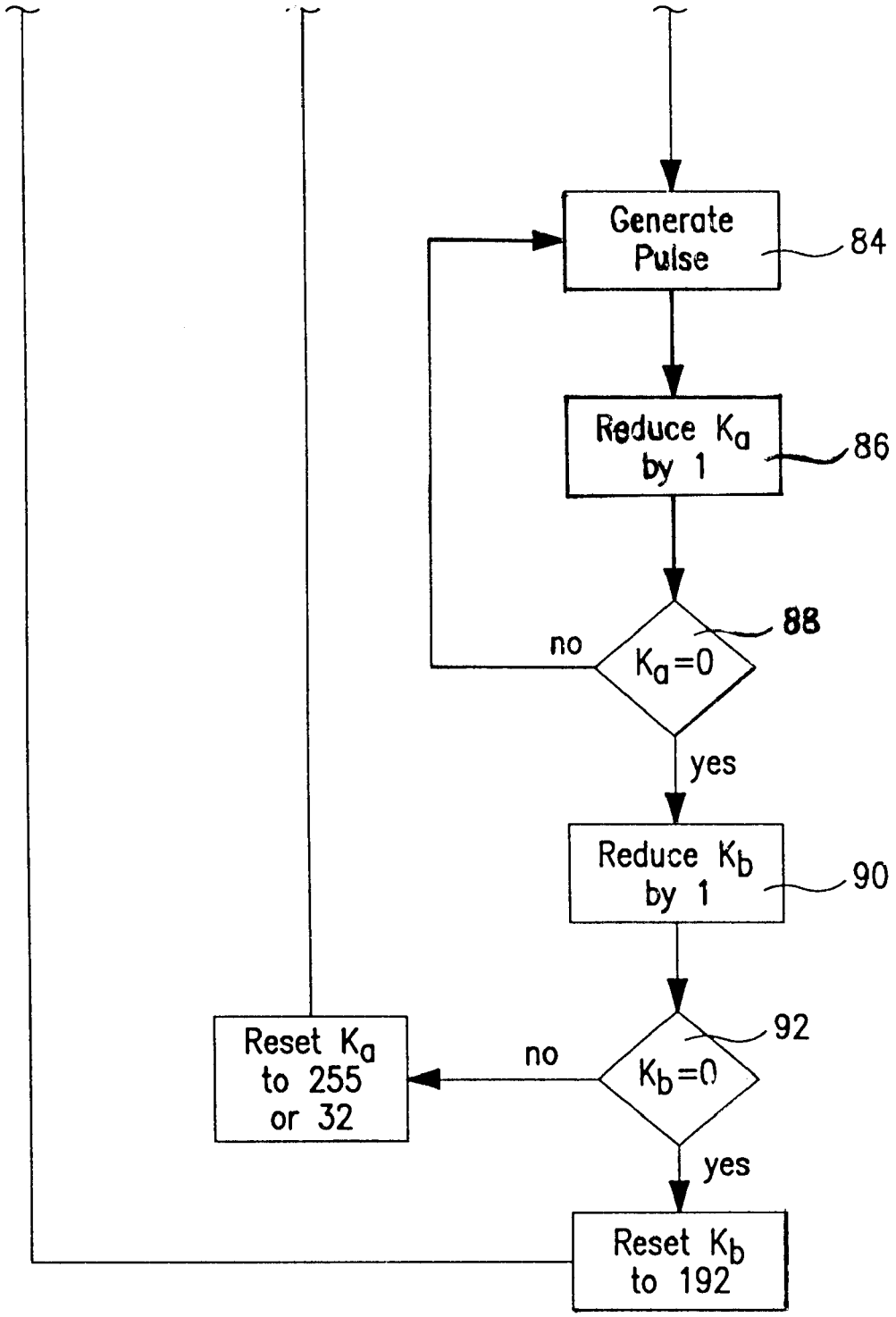
FIG. 6 is a second portion of the flow chart of FIG. 5.

With reference to FIGS. 5 and 6, the microcontroller 38 executes a timing loop to monitor the inputs of the switches 50, 46 and the input voltage. The microcontroller adjusts the pulse width of the current to the coil 18 in response to the monitoring. The microcontroller 38 operates the timing loop in either a normal mode or an enhanced mode. In the enhanced mode, the microcontroller monitors the status switches and other input information on a more frequent basis relative to the normal mode. After an initial start-up step 61, the microcontroller 38 sets a constant $K_a$ equal to 255 for the normal mode, or equal to 32 for the enhanced mode at step 62. Furthermore, the microcontroller 38 sets a second constant $K_b$ equal to 192. The microcontroller 38 then performs a bond test by the magnetic bond sensor 44 at step 64. If the magnetic bond sensor indicates inadequate electromagnetic bonding between the electromagnet assembly and the armature at step 64, the fault relay signals a remote lock system (not shown) that the door 20 is not secured. The magnetic bond sensor fault relay for input voltage monitoring is next set or reset at step 66.

The microcontroller 38 next samples the voltage at the A/D converter 39 at step 68. The value sampled at step 68 is compared to the previous sample value at step 70. If the compared values are not the same, the microcontroller 38 recalculates at step 72 the appropriate width of the pulse. If the compared values are the same, or after the microcontroller 38 recalculates the appropriate width of the pulse, the microcontroller 38 then at step 74 checks the status of the automatic relock switch 50. If the microcontroller 38 is in the enhanced supervisor mode at step 76, the microcontroller performs additional monitoring tasks 80 associated with the enhanced supervisor mode. These enhanced tasks can include monitoring additional status switches, such as anti-tamper switches, checking event timers and performing other tasks associated with enhanced operation of the electromagnetic lock 10.

At step 82, the microcontroller 38 sets the pulse width and generates the pulse to the coil 18 at step 84. Next, $K_a$ is reduced by 1 at step 86 and $K_a$ is evaluated to see if it has reached 0 at step 88. The microcontroller 38 returns through the timing loop to generate pulses at 84 until $K_a$ is reduced to 0.

In the enhanced supervisor mode, $K_a$ is originally set to a lower value of 32. Therefore, the microcontroller 38 more quickly completes the timing loop of generating pulses. When $K_a$ reaches 0 in either the normal or enhanced modes, the microcontroller 38 at step 90 reduces $K_b$ by 1. At step 92, the microcontroller 38 determines if $K_b$ has reached 0. If $K_b$ has not reached 0, the microcontroller resets $K_a$ to either 255 or 32, dependent upon the operational mode, and returns to sample the input voltage at step 68. When $K_b$ reaches 0 at step 92, the microcontroller resets $K_b$ to 192 and, returns to test the magnetic bond sensor 64. The microcontroller 38 generally operates the timing loop routine continually as long as power is applied to the lock controller 36.

In the normal operational mode of the timing loop routine of the microcontroller 38, the microcontroller 38 will preferably perform a test by the magnetic bond sensor 64 approximately every three seconds. The magnetic bond sensor 44 determines the level of bonding between the electromagnet assembly 12 and the armature plate 34 by stopping the pulse of the coil 18 and applying full current to the coil for a short period of time. If the bonding between the electromagnet assembly 12 and armature plate 24 is inadequate, the microcontroller 38 preferably increases the width of the pulses to return to the initial pulse width, therefore increasing the current and the bonding force of the electromagnet assembly 12. The microcontroller 38 again waits the preestablished time before reducing the pulse width to the intermediate level. If after three attempts, the magnetic bond sensor 44 still indicates an inadequate bond, the microcontroller 38 maintains the current at the reduced level in order to prevent overheating of the electromagnet assembly 12.

It should be recognized that the microcontroller 38, in accordance with the invention, can be incorporated into a complete security system and be fully responsive to fire alarm and other emergency operations.

While a preferred embodiment of the present invention has been illustrated and described in detail, it should be readily appreciated that many modifications and changes thereto are within the ability of those of ordinary skill in the art. Therefore, the appended claims are intended to cover any and all of such modifications which fall within the true spirit and scope of the invention.

What is claimed is:

1. An electromagnetic lock comprising:

an electromagnet;

an armature for bonding engagement to said electromagnet, one of said armature and said electromagnet being adapted for mounting to a door, and the other of said electromagnet and said armature adapted for mounting to a door frame;

a status device for generating a door status signal indicative of the status of the door; and controller means for controlling initial pulses of current to said electromagnet, said initial pulses initiated in response to said door status signal and each said initial pulse having a preestablished initial pulse width and a preestablished initial pulse spacing between initial pulses.

2. The electromagnetic lock of claim 1 wherein said controller means maintains said initial pulsing for a predetermined time period, and reduces said initial pulse width to an intermediate pulse width after said preestablished time.

3. The electromagnetic lock of claim 2 wherein said intermediate pulse width is generally one half of said initial pulse width.

4. The electromagnetic lock of claim 2 further comprising a magnetic bond sensor means for generating a bond signal indicative of inadequate bonding engagement between said electromagnet and said armature, said lock controller further for receiving said bond signal and increasing said intermediate pulse width to said initial width.

5. The electromagnetic lock of claim 1 wherein said controller means further monitors an input voltage and adjusts said initial pulse width in response to said input voltage.

6. The electromagnetic lock of claim 2 wherein said controller means further monitors an input voltage and adjusts said intermediate pulse width in response to said input voltage.

7. The electromagnetic lock of claim 1 wherein said controller means comprises a microcontroller and a switch assembly, said microcontroller controlling said switch assembly to generate said pulses.

8. The electromagnetic lock of claim 7 wherein said initial pulse spacing is a frequency of generally over 20 kHz.

9. The electromagnetic lock of claim 7 wherein said switch assembly compromises a metal oxide semiconductor field effect transistor.

10. A lock controller for an electromagnetic door lock comprising an electromagnet, an armature for electromagnetic bonding to said electromagnet and a power supply to provide current to said electromagnet, said lock controller compromising:

switch means for switching said current to said electromagnet on and off;

a door status switch for generating a door status signal indicative of the status of the door; and microcontroller means for controlling said switching of said switch means, said microcontroller means responsive to said door status signal to initiate switching said switch means to generate initial pulses of current, said initial pulses having a preestablished initial pulse width and a preestablished initial pulse spacing between pulses.

11. The lock controller of claim 10 wherein said microcontroller means further varies the width of said pulses.

12. The lock controller of claim 10 wherein said initial pulse spacing is a frequency generally over 20 kHz.

13. The lock controller of claim 10 wherein said microcontroller means controls said switch means to generate pulses of an initial width for a preestablished time and subsequently controls said switch means to generate intermediate pulses having an intermediate pulse width smaller than said initial pulse width.

14. The lock controller of claim 13 wherein said intermediate pulse width is generally one half of said initial pulse width.

15. The lock controller of claim 10 wherein said microcontroller means monitors the input voltage from said power supply and varies said initial pulse width in relation to said input voltage.

16. The lock controller of claim 13 wherein said microcontroller means monitors the input voltage of said power supply, and varies said intermediate pulse width in relation to said input voltage.

17. The lock controller of claim 11 further comprising a magnetic bond sensor for generating a bond signal indicative of inadequate bonding between the electromagnet and the armature, said microcontroller means further for receiving said bond signal and increasing said pulse width from said intermediate pulse width to said initial pulse width in response to said bond signal.

18. The lock controller of claim 10 wherein said switch means comprises a metal oxide semiconductor field effect transistor.

19. A method for operating an electromagnetic lock having an electromagnet and an armature for electromagnetic bonding thereto, said method comprising:

monitoring the status of a door and generating a door status signal indicative of said status of the door; and pulsing current to said electromagnet in response to said door status signal, each pulse of current having a predetermined pulse width and a predetermined spacing of time between said pulses.

20. The method of claim 19 further comprising:

waiting a predetermined time and reducing the pulse width of said pulses to said electromagnet.

21. The method of claim 20 wherein said pulse width is reduced by generally one half.

22. The method of claim 19 further comprising waiting a predetermined time and increasing the spacing between said pulses.

23. The method of claim 19 wherein the electromagnet is supplied with an input voltage, said method further comprising monitoring said input voltage and adjusting said pulse width in response to said monitoring.

24. The method of claim 20 further comprising monitoring the bonding between the electromagnet and the armature after reducing said pulse width and generating a bond signal indicative of inadequate bonding, and increasing the pulse width in response to said bond signal.

* * * * *